US005729863A

United States Patent [19]

Papesh

[11] Patent Number: 5,729,863

[45] Date of Patent: Mar. 24, 1998

[54] SPRAY MIST COLLECTOR FOR SPRAY GUNS

[76] Inventor: Thomas S. Papesh, 121 S. Joliet Rd., Plainfield, Ill. 60544

[21] Appl. No.: 582,839

[22] Filed: Jan. 2, 1996

[51] Int. Cl.[6] ..... A47L 9/02

[52] U.S. Cl. ..... 15/322; 15/393; 15/415.1; 15/422

[58] Field of Search ..... 15/320, 321, 322, 15/393, 415.1, 422

[56] References Cited

U.S. PATENT DOCUMENTS

| | | | |
|---|---|---|---|
| 1,575,939 | 3/1926 | Sattewhite et al. | 15/393 X |
| 1,982,345 | 11/1934 | Kirby | 15/321 |
| 1,994,869 | 3/1935 | Replogle | 15/422 |
| 2,270,579 | 1/1942 | Chamberlin et al. | 15/321 |
| 2,531,920 | 11/1950 | Raminger | 15/422 X |
| 3,238,556 | 3/1966 | Martin | 15/415.1 X |
| 3,747,155 | 7/1973 | Koellisch | 15/322 |
| 3,919,729 | 11/1975 | Cannan | 15/321 X |
| 4,521,935 | 6/1985 | Johnston et al. | 15/322 |
| 5,267,372 | 12/1993 | Jones | 15/415.1 X |

*Primary Examiner*—Chris K. Moore
*Attorney, Agent, or Firm*—Ernest Kettelson

[57] ABSTRACT

A spray mist collector for use with a spray gun, such collector connected to a vacuum source to draw the spray mist surrounding the spray of paint or other sprayable material emitted from the nozzle of the spray gun to the intake apertures of the collector where the particles suspended in the spray mist are trapped by a filter. The spray mist collector has a connection mechanism for connection to the spray gun whereby its expanded intake apertures are automatically pointed at the spray mist surrounding the spray of paint as the painter directs it on to the work object. The filters are replaceable when they become filled, and an adjustable signal mechanism may also be included to indicate when the filters should be changed. The rearward duct portion of the spray mist collector is connected to an elongated flexible air hose or air conduit which leads to a vacuum source. The spray mist collector may be large for use with large spraying equipment or small for use with small spraying appliances such as aerosol paint spray cans. The duct assembly of the spray mist collector may even be formed integrally with certain types of spray guns or spray equipment. Whether integrally formed or removably connectable, the spray mist collector is made of light weight materials which add very little weight to the spray equipment to which it is attached.

17 Claims, 9 Drawing Sheets

SPRAY MIST COLLECTOR FOR SPRAY GUNS

BACKGROUND OF THE INVENTION

This invention relates to a spray mist collector for spray guns used to spray paint and other sprayable materials in which a mist surrounds the spray of paint or the like as it is being applied. Such spray mist includes minute particles of the material being sprayed, which can be hazardous to the health of workers when allowed to escape into the atmosphere where it can be breathed in by workers and others in the area. In accordance with this invention, a spray mist collector having one or more expanded intake apertures around or on each side of the spray gun and slightly to the rear of the nozzle, draws the undesirable spray mist into and through the intake apertures and the ducts of the collector which are connected to a vacuum source or a vacuum generating source. Filters are provided to trap the minute spray particles, which are replaced when they become filled.

SUMMARY OF THE INVENTION

The present invention solves the problem of hazardous spray mist materials escaping into the atmosphere, which occurs with the presently known prior art way of spraying paint and other types of sprayable materials. A spray mist collector of very light weight is secured to the spray gun, comprising enlarged or expanded intake apertures to draw in the spray mist surrounding the spray of paint or the like, by operation of the vacuum to which the intake apertures are connected.

The enlarged intake apertures are positioned to each side of the spray gun nozzle, and they extend above and below such nozzle. They may extend entirely around the nozzle, and they are positioned slightly behind the nozzle. The enlarged or expanded intake apertures are positioned to face forwardly in the same general direction as the spray emitted from the spray gun nozzle. In a preferred embodiment, the intake apertures may face slightly outwardly from the longitudinal axis of the spray center wherein the axes of the intake apertures form an acute angle facing forwardly with the longitudinal axis of the nozzle and of the spray emitted therefrom. Such positioning of the intake apertures enables the spray mist collector to cover a larger area surrounding the spray nozzle from which spray mist will be drawn in and collected.

Such positioning of the expanded intake apertures on the spray gun itself automatically points the apertures in the direction of the spray mist that is to be collected when the spray gun is pointed at the portion of the work object to which the paint or other sprayable material is being applied. In other words, the workman does not have to divert his eyes and attention from the paint spraying or other primary application he is working on. He can direct his attention solely to that work and the spray mist collector in accordance with the present invention will automatically be pointed in the correct position to perform its function of collecting the hazardous spray mist which extends outwardly from and around the spray of paint or other sprayable material that is being applied.

The enlarged or expanded intake apertures open to the cavity or passageway of a duct assembly that extends rearwardly above the spray gun. A connecting member is secured to a portion of the duct assembly having a receiving cavity or channel to receive a portion of the spray gun, such as the nozzle housing that extends rearwardly of the nozzle. Set screws or other securing devices are provided to releasably secure the spray mist collector to the spray gun.

An air hose or other type of elongated flexible air tight conduit leading from a vacuum generating source is connected to the duct assembly of the spray mist collector, which may include a venturi structure in the air flow stream, to provide the vacuum pressure needed to effectively collect the spray mist, as set forth in the more detailed description of a preferred embodiment which follows.

Replaceable filters are mounted over the expanded intake apertures to collect the minute spray particles as the spray mist is drawn into the spray mist collector. The filters are replaced with new ones as the existing ones become filled with the collected spray particles. The used filters with the collected waste spray materials, which at present escape as pollutants into the atmosphere when presently known prior art methods of paint spraying and the like are used, may then be easily disposed of in an approved manner.

An alarm or signalling device is incorporated into the spray mist collector in accordance with this invention to indicate when the filters need to be replaced. Such alarm or signalling device includes a whistle or other sound generating device positioned for air to flow by or through in response to the vacuum created by the vacuum generating source to produce an audible signal when air flow through the filter becomes restricted from being sufficiently filled with spray mist particles to the point it should be replaced.

Other and more complete advantages and features of the present invention will be seen from the more detailed description of a preferred embodiment which follows.

DESCRIPTION OF PREFERRED EMBODIMENT

Figure 1:
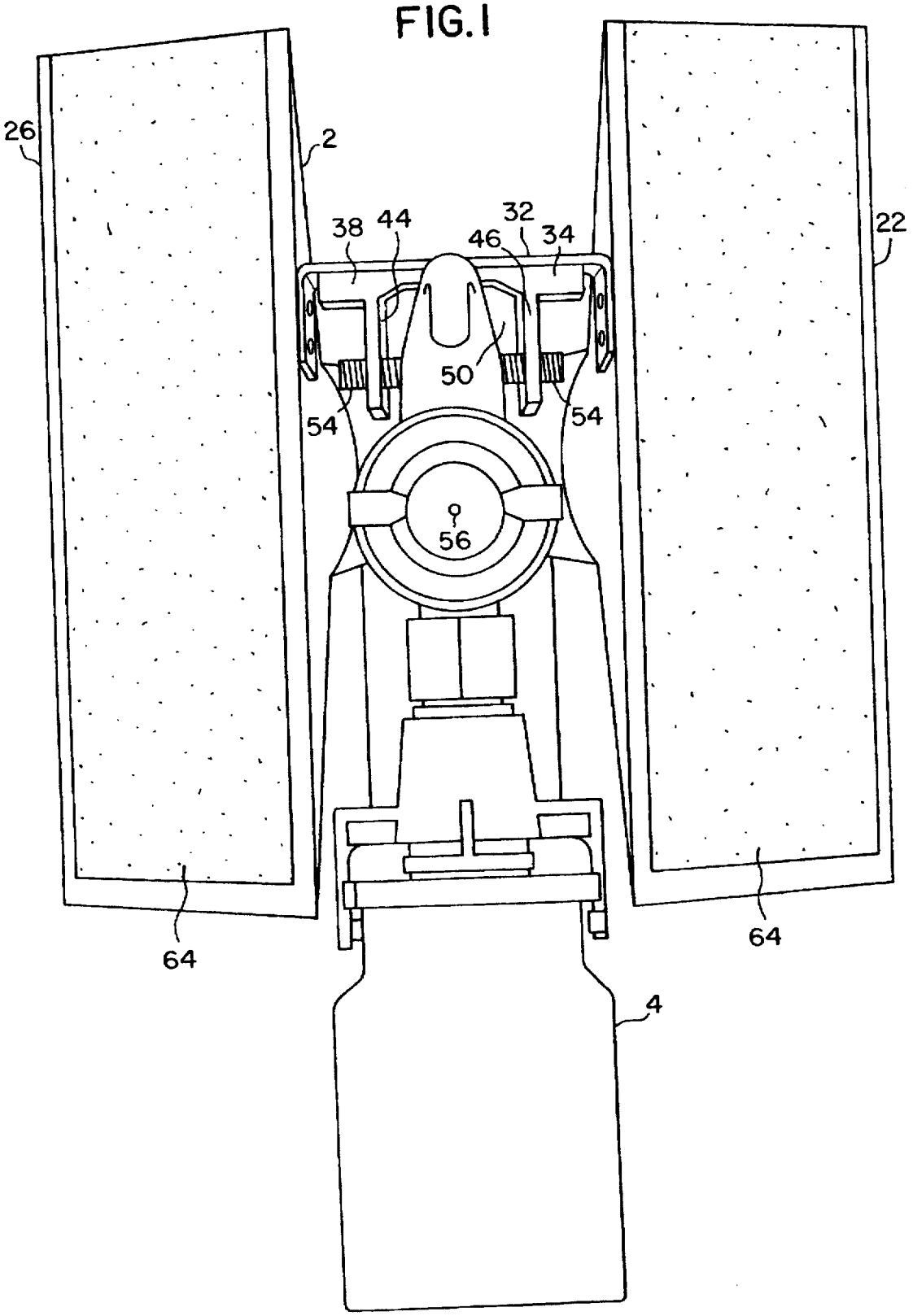
FIG. 1 is a front elevation view of a spray mist collector in accordance with this invention secured to a spray gun.
Figure 2:
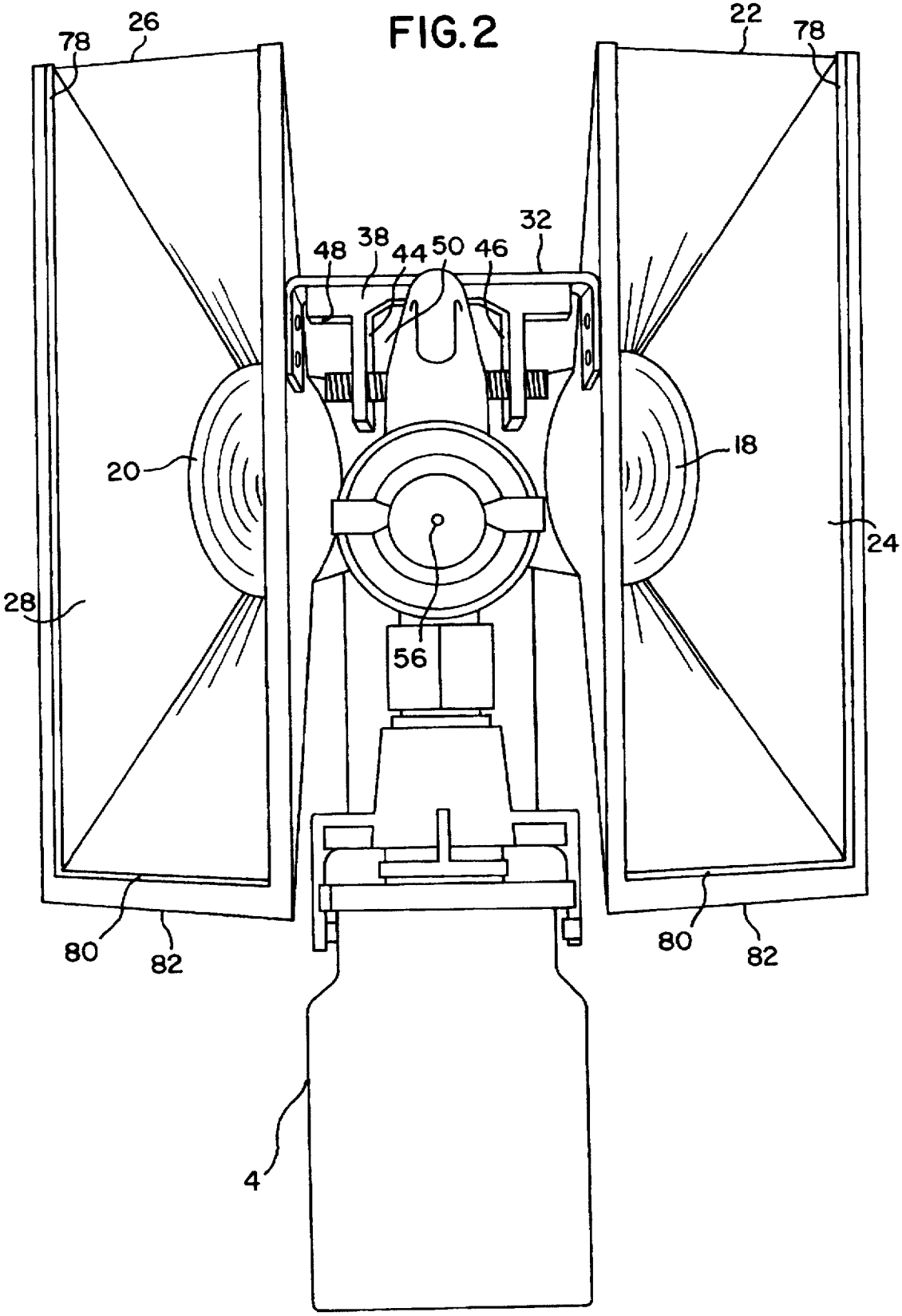
FIG. 2 is a front elevation view of a spray mist collector secured to a spray gun as in FIG. 1, but with filters removed from the enlarged intake apertures.
Figure 3:
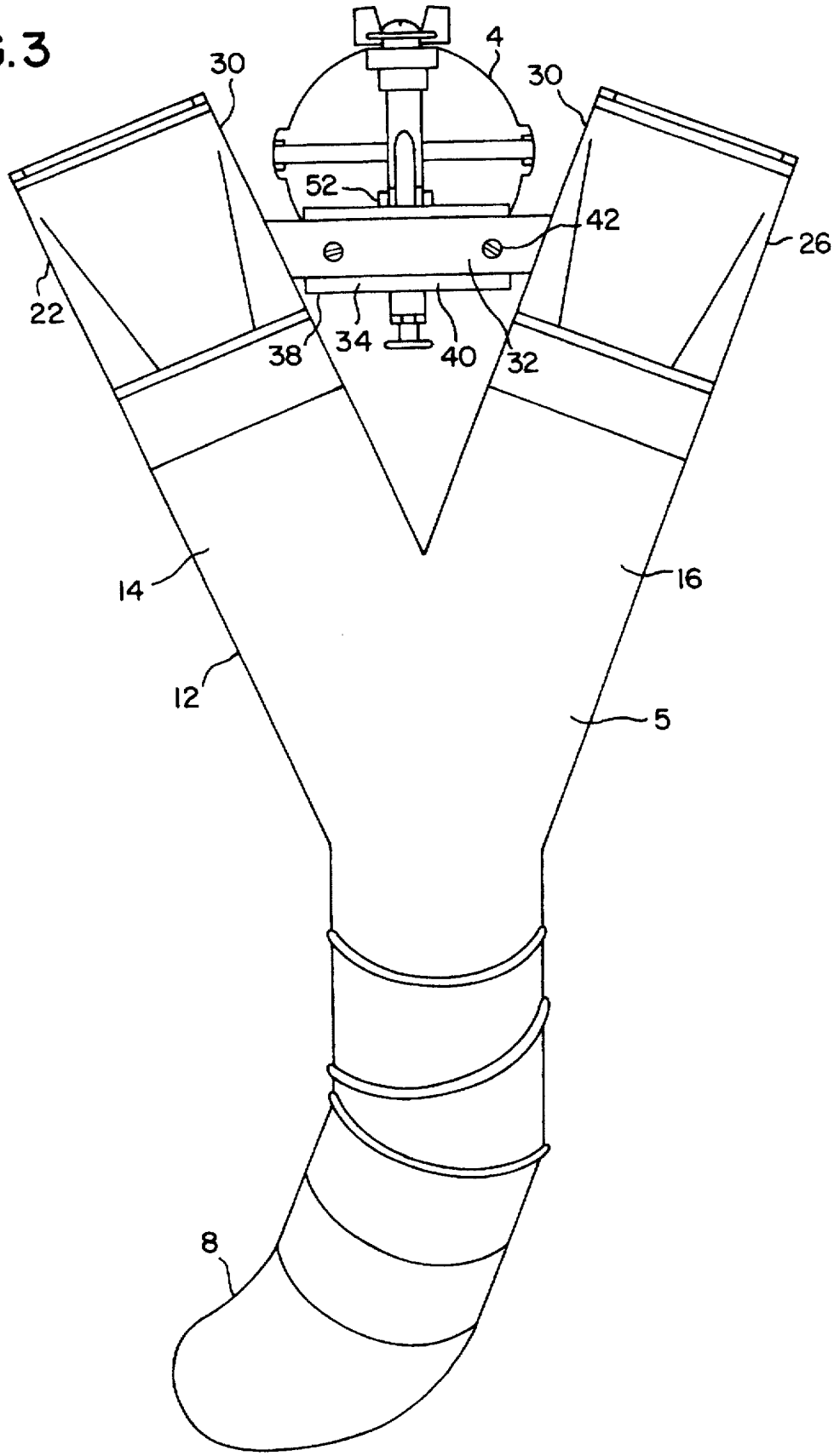
FIG. 3 is a top plan view of a spray mist collector secured to a spray gun.
Figure 4:
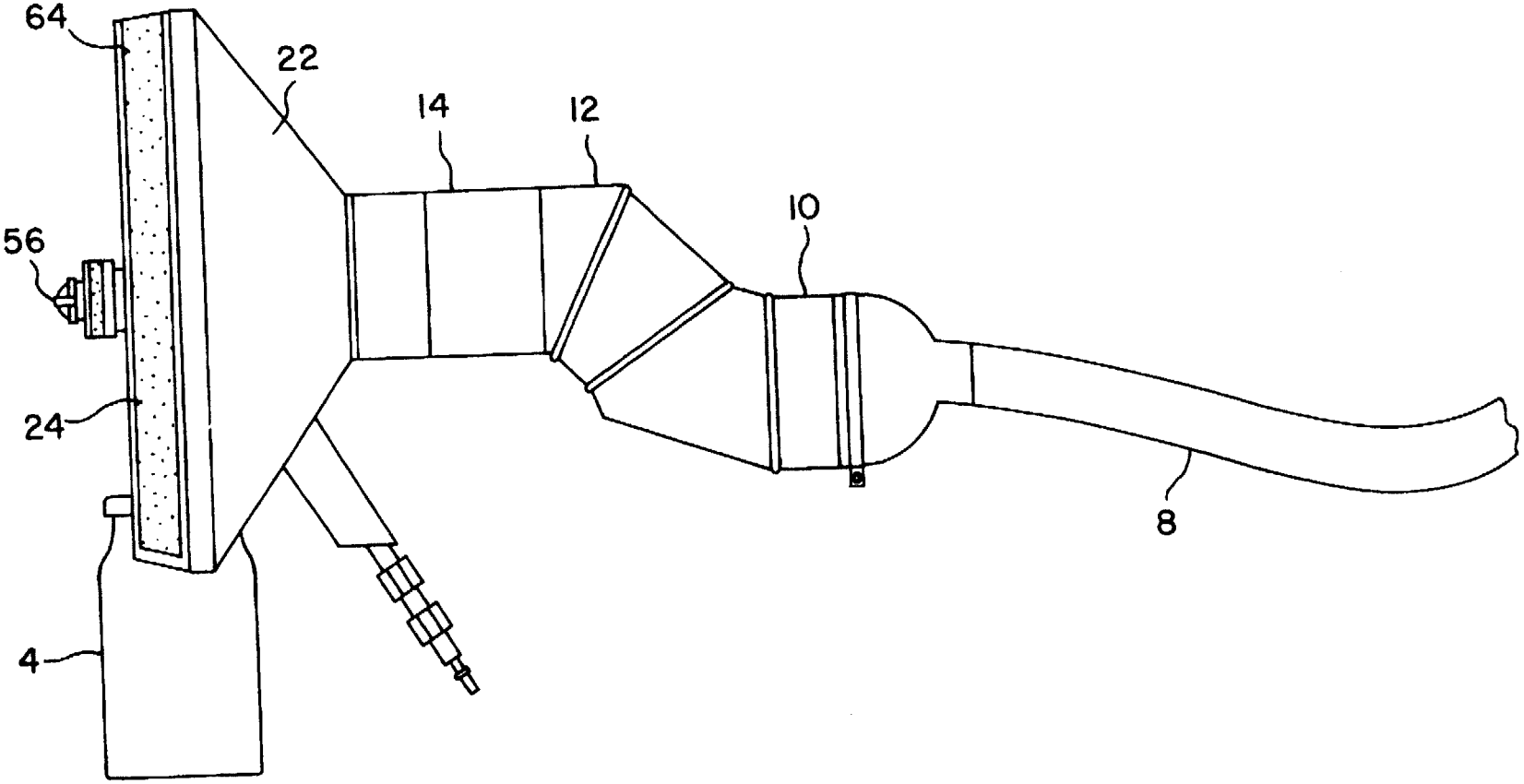
FIG. 4 is a side elevation view of a spray mist collector in accordance with this invention secured to a spray gun, and showing a portion of the flexible air hose leading from the spray mist collector to a vacuum generating source (not shown).
Figure 5:
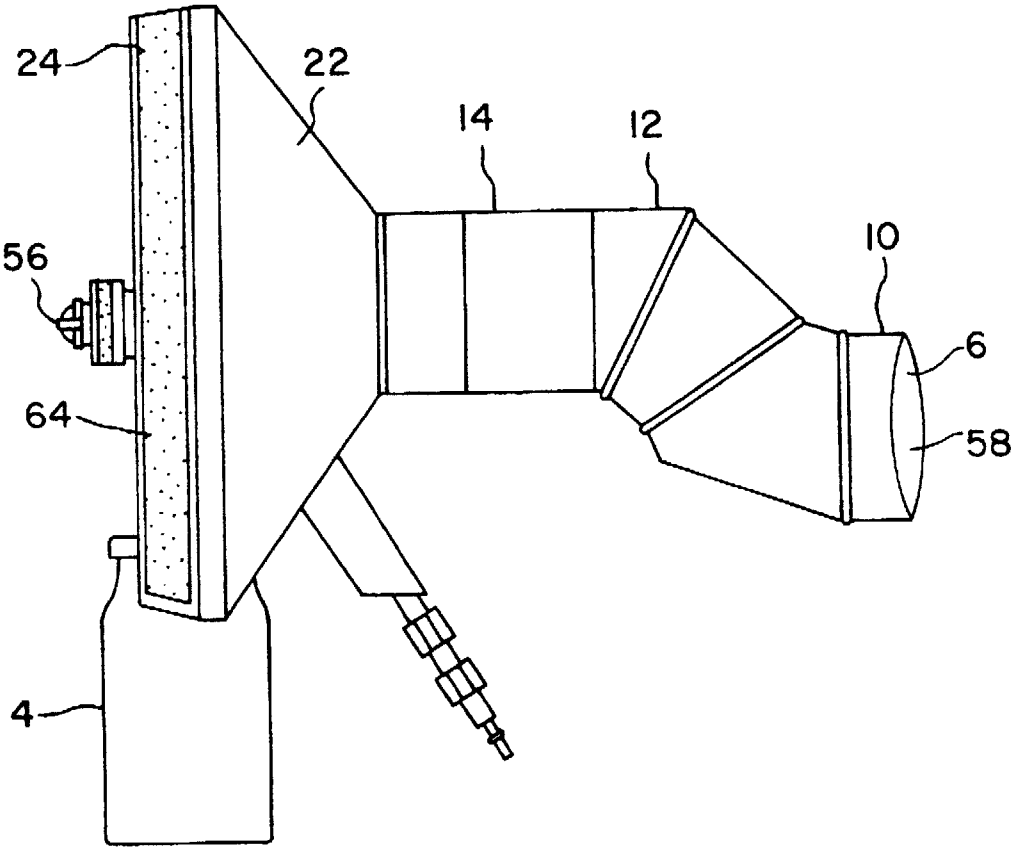
FIG. 5 is a side elevation of the spray mist collector and spray gun as shown in FIG. 4, but shown disconnected from the air hose leading to the vacuum generating source to show the outlet aperture and duct passageway of the rearward portion of the duct assembly.
Figure 6:
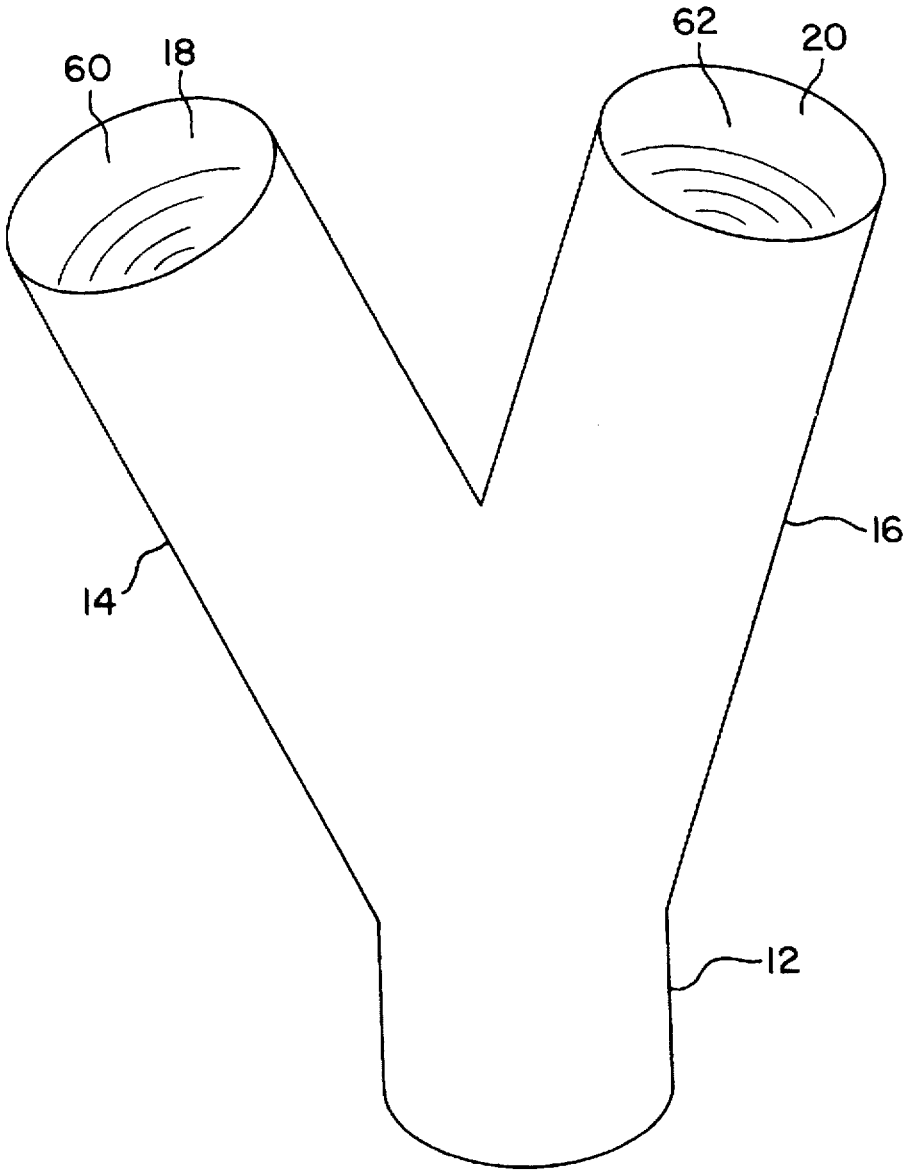
FIG. 6 is a perspective view of the Y-shape duct portion disconnected from the remaining portion of the duct assembly to show the intake apertures thereof and the duct passageways.
Figure 7:
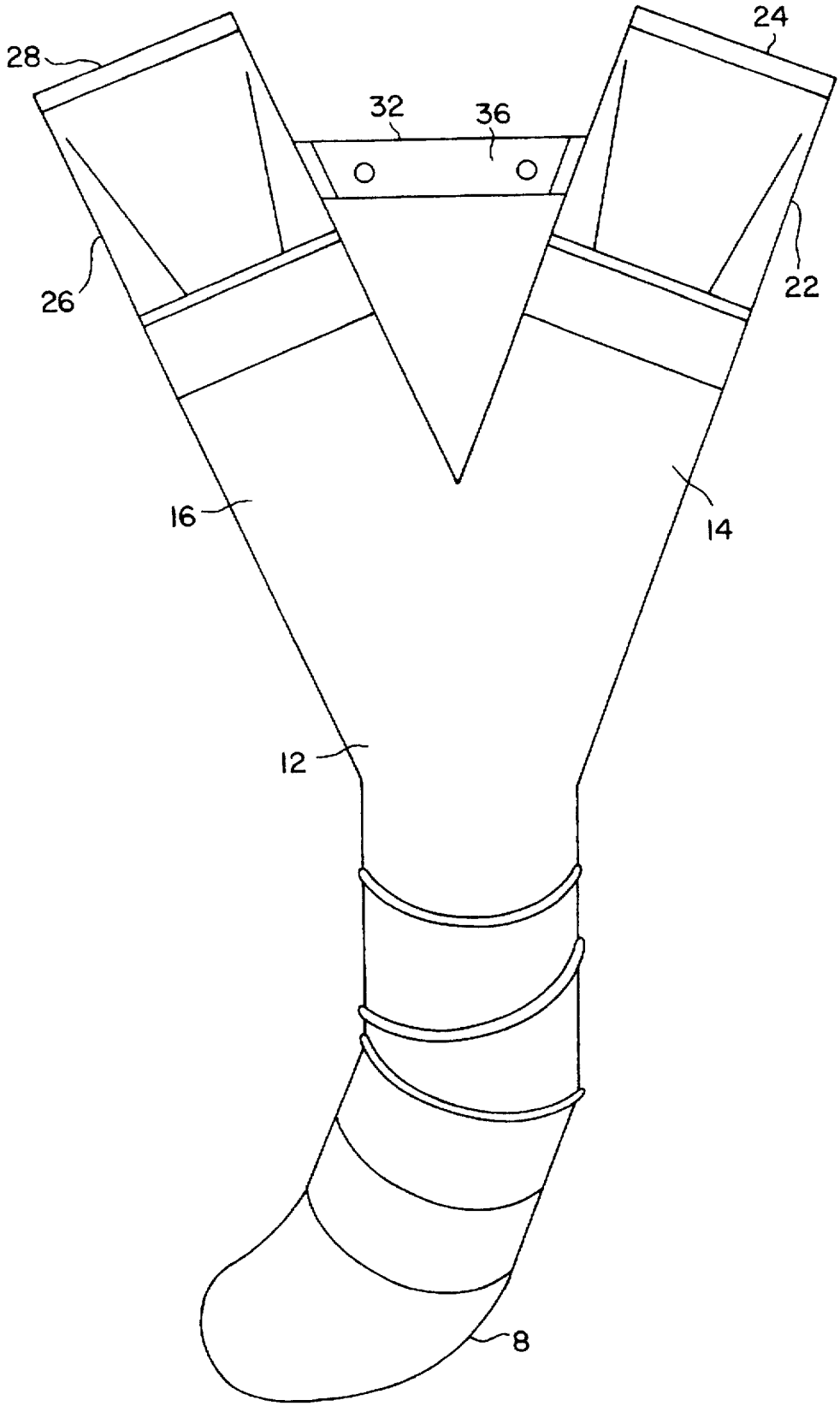
FIG. 7 is a bottom plan view of the spray mist collector shown disconnected from the spray gun.
Figure 8:
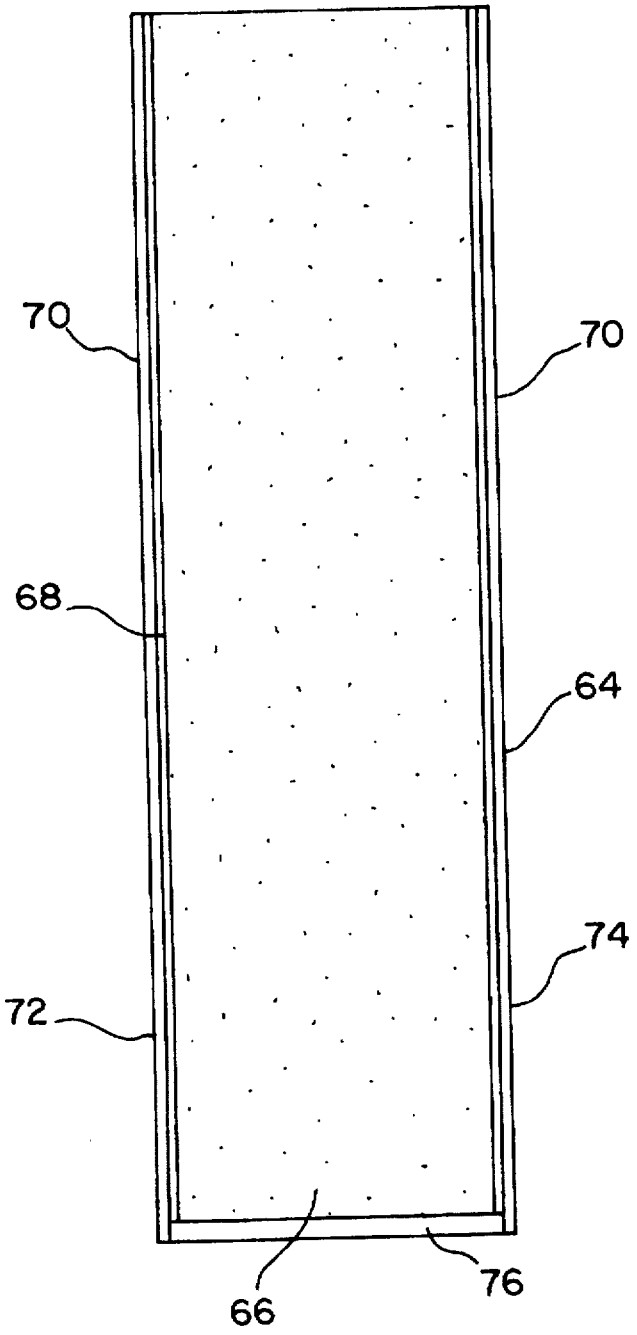
FIG. 8 is a front elevation view of a filter shown its place over an expanded intake aperture to removed from illustrate the side rails, the filter frame and the laterally extending bottom insert member which seats in the receiving recess along the bottom wall of the intake aperture.
Figure 9:
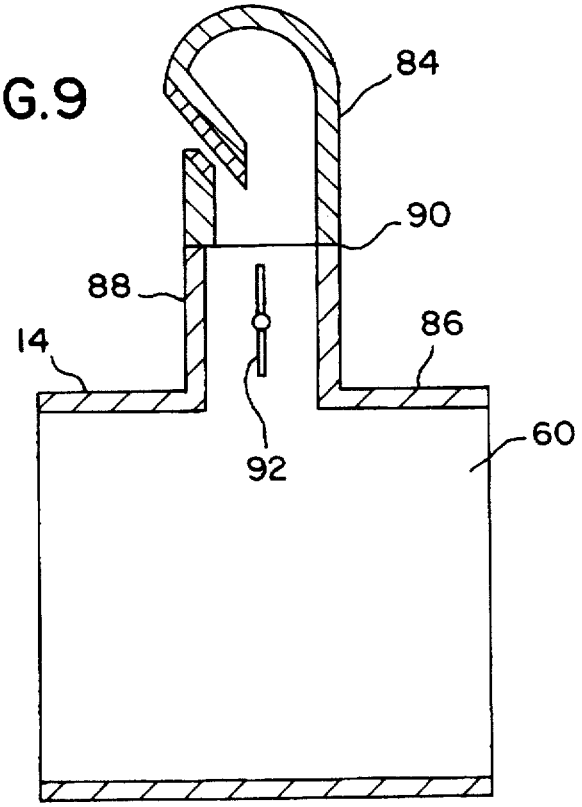
FIG. 9 is a section view of a signalling device comprising a whistle to make an audible sound when a filter needs to be replaced, and of a tubular mounting member having an adjustment valve therein which may be used to mount the signalling device to one of the legs of the Y-shaped duct member immediately behind its expanded intake aperture and its filter; this figure shows the whistle and tubular mounting member mounted on one leg of the Y-shaped duct member and with the adjustment valve in its fully open position.
Figure 10:
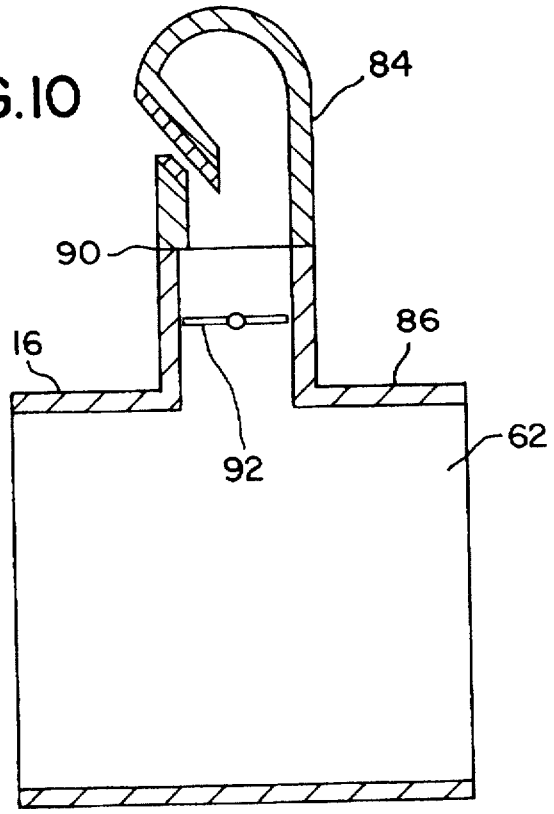
FIG. 10 is a section view of a whistle and mounting member as shown in FIG. 9, but mounted on the other leg of the Y-shaped duct member and with the adjustment valve in its fully closed position.

A spray mist collector for use with spray guns in accordance with this invention includes a spray mist collector 2 for connection to, or already connected to, a spray gun 4 of the kind used for spraying paint as well as other kinds of sprayable materials.

The spray mist collector 2 comprises a duct assembly 5 for connection to a vacuum source such as the intake side of a blower, a vacuum canister or vacuum chamber, and the like. Such duct assembly 5 includes an outlet aperture 6 for connection to a conduit 8 which in turn is connected to a vacuum source. Such conduit 8 may comprise an elongate flexible tube leading from the spray gun 4 and attache spray mist collector 2 for connection to a remotely place vacuum generating source. The user can then move the spray gun 4 and its attached spray mist collector 2 freely while spraying the work object with paint.

The duct assembly 5 includes a short length of duct 10 extending forwardly from its outlet aperture 6 to a Y-connector duct portion 12, which comprises a first duct leg 14 extending angularly in one direction from the short length of duct 10 and a second duct leg 16 extending angularly in the opposite direction from the short length of duct 10. The first duct leg 14 terminates in a first intake aperture 18 and the second duct leg 16 terminates in a second intake aperture 20.

A first vacuum intake member 22 having an expanded intake aperture 24 is connected to the first intake aperture 18 of the first duct leg 14 of the Y-connector duct portion 12. A second vacuum intake member 26 having an expanded intake aperture 28 is connected to the second intake aperture 20 of the second duct leg 16 of the Y-connector duct portion 12.

The vacuum intake members 22 and 26 each have peripheral duct wall 30 which diverges outwardly from their respective connections to the first and second duct legs 14 and 16 outwardly to their respective expanded intake apertures 24 and 28.

A connecting plate 32 extends across from the first vacuum intake member 22 to the second vacuum intake member 26 of the Y-connector portion 12, connected at each opposite end to the respective peripheral duct wall 30 of each vacuum intake member 22 and 26. A spray gun connecting member 34 is connected to the downwardly facing surface 36 of the connecting plate 32, to connect the spray mist collector 2 to the spray gun 4.

The connecting member 34 comprises a base 38 having an upwardly facing surface 40 connected to the downwardly facing surface 36 of the connecting plate 32 by screws 42, or by welding or by other suitable means. A pair of spaced apart side walls 44 and 46 extend downwardly from the downwardly facing surface 48 of the base 38 of connecting member 34 defining a spray gun receiving channel 50 therebetween.

To connect the spray mist collector 2 to spray gun 4, a portion of the elongated nozzle assembly housing 52 of the spray gun 4 is received in the receiving channel 50 of the spray mist collector 2. Set screws 54 threaded through side walls 44 and 46 of the connecting member 34 are tightened against the nozzle assembly housing 52 to secure the spray mist collector 2 to the spray gun 4.

The spray mist collector 2 is secured to the nozzle assembly housing 52 at a location which places the expanded intake apertures 24 and 28 just slightly to the rear longitudinally of the nozzle 56 of the spray gun 4 and to each side thereof laterally.

When secured to the spray gun 4 as described, the axis of the duct passageway 58 of the rearward short length of duct 10 of the spray mist collector 2 is substantially in line axially with the longitudinal axis of the spray gun nozzle assembly housing 52 and of the spray emitted from the nozzle 56. The axis of the duct passageway 60 of the first duct leg 14 of the Y-connector duct portion 12 extends at a forwardly facing acute angle to the longitudinal axis of the spray gun nozzle assembly housing 52 and of the spray emitted from the nozzle 56 at one side thereof. The axis of the duct passageway 62 of the second duct leg 16 of the Y-connector duct portion 12 extends at a forwardly facing acute angle to the longitudinal axis of the spray gun nozzle assembly housing 52 and of the spray emitted from the nozzle 56 at the opposite side thereof.

Such forwardly facing acute angles at which the axes of the duct passageways 60 and 62 extend are substantially equal and are preferably between twenty and thirty degrees That is, the axes of the duct passageways 60 and 62 diverge outwardly from the longitudinal axis of the spray gun nozzle assembly housing 52 and of the spray emitted from the nozzle 56 as they extend forwardly at any desired angle selected between twenty degrees and thirty degrees.

The expanded intake aperture 24 of the first vacuum intake member 22 connected to the first duct leg 14 defines a planar open wall which extends in a plane that is normal to the axis of the duct passageway 60 of such first duct leg 14.

The expanded intake aperture 28 of the second vacuum intake member 26 connected to the second duct leg 16 defines a planar open wall which extends in a plane that is normal to the axis of the duct passageway 62 of such second duct leg 16.

The expanded intake apertures 24 and 28 thereby face in angular directions to each side of the spray gun nozzle 56, in position to draw in spray mist that expands in a cone-like formation outwardly from and around the nozzle 56. Such placement of the duct legs 14 and 16 and of the expanded intake apertures 24 and 28 enables the spray mist collector 2 to operatively cover the entire area of spray mist or spray particles emitted from the nozzle 56 of the spray gun 4 to each side thereof, and to effectively collect such spray mist and spray particles from such area when connected to a vacuum source and in operation.

The expanded intake apertures 24 and 28 extend vertically a sufficient distance above and below the level of the longitudinal axis of the nozzle 56 and of the spray mist emitted therefrom to operatively cover the entire area of spray mist or spray particles emitted from the nozzle 56 throughout the area above and below the nozzle, and to effectively collect such spray mist or spray particles when so connected and operated.

By way of example for use with a typical spray gun, the expanded intake apertures 24 and 28 each have a vertical dimension of about ten inches and a horizontal dimension of about four inches. The diameter of the intake duct passageways 60 and 62 of the first and second duct legs 14 and 16 connected to the first and second vacuum intake members 22 and 26 in the example given is preferably about three and a half inches. The diameter of the duct passageway 58 of the rearward short length of duct 10, to which duct legs 14 and 16 and duct passageways 60 and 62 are connected, is about five inches in the example given.

The static pressure of the vacuum provided at the expanded intake apertures by the vacuum creating mechanism to which the spray mist collector as described herein is connected should be about three-fourths inches in a column of water, or about 0.005 pounds per square inch (psi).

Replaceable filters 64 are provided to cover the expanded intake apertures 24 and 28 and to trap the minute solid and liquid particles of the spray mist as it is drawn into the expanded intake apertures. Only the gaseous portion of the spray mist is drawn completely through the filters 64 and into the duct assembly 5 of the spray mist collector.

The filters 64 include filter pads 66 which are able to trap and collect solid and liquid particles of a spray mist created by a pressurized spray gun used to spray paint and other sprayable materials. The filter pads 66 may include materials such as fiber glass fibers, various fabric making materials such as cotton fibers, a plurality of superimposed layers of netting in offset relationship, and the like. The filter pads 66 may also contain adsorption material such as activated charcoal.

Each filter pad 66 is mounted in a filter frame 68 having elongated guide rails 70 along each opposite side 72 and 74, and a laterally extending insert member 76 along the bottom edge. The guide rails 70 of the filter frame 68 are received in respective ones of elongated receiving slots 78 formed along the inner surfaces of the vacuum intake members 22 and 26 adjacent their respective expanded intake apertures 24 and 28, to insert the filters 64 in place to cover such expanded intake apertures. The laterally extending insert member 76 of the filter frame 68 seats in the laterally extending receiving slot 80 along the bottom wall 82 of each vacuum intake member 22 and 26 adjacent their respective expanded intake apertures 24 and 28.

The filters 64 are thereby readily replaceable with new filters when the existing ones become too filled with particles for further effective use. When air flow through the filters becomes restricted because they have become clogged and need to be replaced, ambient air pressure on the outer surfaces of the duct walls begins to increase since the vacuum generating source continues to create the same vacuum in the duct passageway and the intake area of the intake apertures is substantially reduced by the clogged filters. The same amount of outside air cannot enter the duct passageways through the intake apertures to fill the void created by the vacuum, so to that extent increased outside air pressure is applied to the outer surfaces of the ducts.

The present invention takes advantage of that characteristic to provide an alarm or signal to indicate that the filters have become clogged to the point they need to be replaced.

A whistle or signal mechanism 84 is mounted on the outer surface of the duct wall 86 of each duct leg 14 and 16 of the Y connector duct portion 12 in communication with their respective duct passageways 60 and 62. A small tubular mounting member 88 is secured to the duct wall 86 of each duct leg 14 and 16 and extends outwardly therefrom to terminate at a free end 90. One of the whistles 84 is secured to the outer free end 90 of each of the tubular mounting members 88 on duct legs 14 and 16. The through passageway of each tubular mounting member 88 is in air flow communication with respective ones of the duct passageways 60 and 62 of the duct legs 14 and 16, and in air flow communication with the cavity of each of the respective whistles 84.

Thus, when reduced air flow through the intake apertures results from the filters being clogged, the resulting increase of outside air pressure on the outer surfaces of the duct walls will begin to cause air to flow into the intake apertures of the whistles, through their cavities into the passageway through the tubular mounting members 88 and into the respective duct passageways 60 and 62 of the duct legs 14 and 16, in the direction toward the vacuum generating source. The more the filters become clogged, the greater the air flow through the whistles 84 until it reaches the point where the whistles begin to emit an audible sound.

An air flow adjusting valve 92 is provided in each of the tubular mounting members 88 which can be adjusted between a fully open and fully closed position to control the flow of air through the tubular mounting members from the whistles 84 to the respective duct passageways 60 and 62. The smaller the valve openings, the greater the vacuum within the duct passageways 60 and 62 needed to draw enough air through such smaller opening and the whistles 84 to cause them to emit an audible sound. The greater the valve opening, the less vacuum required in the duct passageways to cause the whistles 84 to sound.

The amount of vacuum build up within the duct passageways 60 and 62 is a function of the amount of air flow permitted through the filters 64. When new and completely unclogged, air flows relatively freely through the filters with little or no increase of vacuum pressure build up within the duct passageways 60 and 62. As the filters become progressively clogged, air flow through the filters becomes progressively reduced and vacuum pressure build-up within the duct passageways 60 and 62 progressively increases.

At some point, the vacuum pressure build-up within the duct passageways 60 and 62 becomes sufficient to cause the whistles 84 to sound with the adjusting valve 92 in its fully open position. At such time, the filters 64 are partially clogged. However, they may not yet be so clogged that they have to be replaced. The adjusting valve 92 can then be moved to a partially closed position to restrict air flow through the whistle 84 until the filters become more clogged and the vacuum pressure build-up within the duct passageways becomes great enough for air flow through the restricted valve opening to in turn become great enough to cause the whistle 84 to sound.

Different types of filters may require different settings of the adjusting valve to indicate when the filters need to be replaced. Differing operating environments, such as a wide range of temperatures of the ambient air, and other factors may require use of the adjusting valve 92 to properly adjust the point at which the filters should be changed and at which the whistles 84 should signal that such change should be made.

Various other alarms to indicate the filters need to be changed are within the scope of this invention, including a battery operated buzzer energized by a limit switch which makes contact when air flow in the ducts drops to a preselected limit that indicates the filters need to be changed, reed members mounted in the ducts which emit a higher pitch sound when air flow is normal and a lower pitch sound resulting from reduced frequency of vibrations when air flow becomes restricted indicating the filters need to be changed, and the like.

The specific embodiment of the spray mist collector described hereinabove is only one of the ways in which this invention may be used. The vacuum spray mist collector may also be modified and adapted for use with previously pressurized containers filled with paint or other sprayable materials in which a collectable spray mist results when used, such as aerosol paint containers and the like.

The expanded intake apertures or aperture may take other shapes and forms than the rectangular ones shown and described hereinabove. They may be circular or oval in shape. A single expanded intake aperture may be provided which extends completely around the nozzle of the spray gun, in either a circular or angular configuration, connected to one or more intake ducts which extend rearwardly from such expanded intake aperture.

The spray mist collector in accordance with this invention may be releasably connectable to the spray gun, as shown and described hereinabove, or it may be integrally formed with the spray gun or with a previously pressurized container of paint or the like, such as an aerosol paint container. The vacuum generating mechanism may be a separate rotary vacuum pump or the like to which the spray mist collector is connectable, or it may be one or more containers in which a vacuum has been previously created of sufficient capacity to provide the vacuum pressure needed for a pre-determined period of time after which another one of such vacuum containers would be connected to the spray mist collector.

In operation, a user grasps the spray gun 4 with his hand and sprays paint or other sprayable material in the usual manner, such spray gun having a spray mist collector 2 in accordance with this invention secured to the spray gun. The spray mist collector 2 is in turn connected to a vacuum generating source by an elongated length of flexible air hose or conduit 8. Such flexible conduit is long enough to permit freedom of movement of the user as he is painting or spraying other sprayable material. The spray mist collector 2 in accordance with this invention and as described herein is made of a lightweight material such as aluminum.

The vacuum generated at the expanded intake apertures 24 and 28 should have a static pressure of about three fourths of an inch in a column of water, or about 0,005 psi. Such vacuum should produce an air flow through the two expanded intake apertures 24 and 28 of the size and configuration described hereinabove of about 1000 cubic feet per minute when the filters 64 are relatively unclogged. Such vacuum pressure and volume of air flow will adequately draw in and collect the spray mist which normally surrounds the spray of paint as it is emitted from the spray gun. The vacuum pressure and volume of air flow can of course be adjusted to accommodate spray devices of various sizes, and still come within the scope of this invention.

When the filters 64 become filled with collected spray particles and need to be replaced, they may simply be lifted out from the receiving slots 78 and 80 bordering the expanded intake apertures 24 and 28 of the vacuum intake members 22 and 26 and discarded. New filters 64 can then be easily put in place by sliding into the receiving slots 78 until their insert members 76 along the bottom edge of the filter frames 68 seat in the receiving slots 80 of the vacuum intake members along the bottom edge of their respective expanded intake apertures.

I claim:

1. A spray mist collector for use with a spray gun having a nozzle to spray paint and other sprayable materials, comprising conduit means for connection to a vacuum generating source, and for allowing flow of air through said conduit means in the direction toward said vacuum generating source, intake aperture means operatively associated with said conduit means to draw a spray mist resulting from use of said spray gun into and through said intake aperture means and said conduit means, wherein said spray mist collector includes connection means for connection thereof to said spray gun, wherein said conduit means includes a conduit member, wherein said intake aperture means includes at least one large intake aperture having a planar cross-section dimension greater than the cross-section dimension of said conduit member, said spray mist collector includes adjustable positioning means to adjust and position said spray mist collector when corrected to said spray gun at a location wherein said large intake aperture of said intake aperture means is positioned slightly to the rear of said nozzle of said spray gun.

2. A spray mist collector for use with a spray gun having a nozzle to spray paint and other sprayable materials, comprising conduit means for connection to a vacuum generating source, and for allowing flow of air through said conduit means in the direction toward said vacuum generating source, intake aperture means operatively associated with said conduit means to draw a spray mist resulting from use of said spray gun into and through said intake aperture means and said conduit means, wherein said spray mist collector includes filter means positioned to filter particles from said spray mist as said spray mist is drawn through said filter means into said intake aperture means and said conduit means.

3. A spray mist collector for use with a spray gun having a nozzle to spray paint and other sprayable materials, comprising conduit means for connection to a vacuum generating source, and for allowing flow of air through said conduit means in the direction toward said vacuum generating source, intake aperture means operatively associated with said conduit means to draw a spray mist resulting from use of said spray gun into and through said intake aperture means and said conduit means, wherein said conduit means includes a light weight duct member connected to said intake aperture means at a first end of said duct member, and an elongated flexible air conduit connected to said light weight duct member at the opposite second end of said duct member, said elongated flexible air conduit being connected at its other end to said vacuum generating source, wherein said intake aperture means includes a first vacuum intake member having a forwardly facing end and a rearwardly facing end, a first large intake aperture of said first vacuum intake member at said forwardly facing end thereof, a second vacuum intake member having a forwardly facing end and a rearwardly facing end, a second large intake aperture of said second vacuum intake member at said forwardly facing end thereof, and duct connecting means to connect said first end of said light weight duct member to said rearwardly facing ends of said first and second vacuum intake members for flow of air through said first and second vacuum intake members into and through said light weight duct member in the direction toward said vacuum generating source.

4. A spray mist collector as set forth in claim 3, wherein said duct connecting means includes a Y-shaped duct member having a short longitudinally extending duct leg terminating rearwardly in a rearwardly facing duct end, a first branching duct leg connected to and extending forwardly at a diagonal in one direction from the forward end of said longitudinally extending duct leg, a second branching duct leg connected to and extending forwardly at a diagonal in the opposite direction from the forward end of said longitudinally extending duct leg, said first branching duct leg having a forward end connected to said rearwardly facing end of said first vacuum intake member, said second branching duct leg having a forward end connected to said rearwardly facing end of said second vacuum intake member, said light weight duct member being connected at said first end thereof to said rearwardly facing duct end of said short longitudinally extending duct leg of said Y-shaped duct member.

5. A spray mist collector as set forth in claim 4, including a connecting member to connect said spray mist collector to a spray gun having a nozzle and a nozzle housing extending rearwardly of said nozzle, said connecting member comprising a laterally extending base connected between said first and second vacuum intake members which extend diagonally from their respective connections to said first and second branching legs of said Y-shaped duct member, and releasable connecting means extending from said base of said connecting member for releasable connection to said nozzle housing of said spray gun.

6. A spray mist collector as set forth in claim 3, wherein said first and second vacuum intake members are spaced apart and wherein said spray mist collector includes a connecting member to connect said spray mist collector to a spray gun having a nozzle and a nozzle housing extending rearwardly of said nozzle, said connecting member comprising a laterally extending base connected between said spaced apart first and second vacuum intake members, and releasable connecting means extending from said base of said connecting member for releasable connection to said nozzle housing of said spray gun.

7. A spray mist collector as set forth in claim 6, wherein said releasable connecting means of said connecting member comprises a pair of spaced apart wall members extending from said base defining a receiving cavity therebetween for reception of said nozzle housing of said spray gun, and at least one set screw through one of said wall members to bear against said nozzle housing when tightened.

8. A spray mist collector as set forth in claim 6, wherein said releasable connecting means of said connecting member comprises a pair of spaced apart wall members extending from said base defining a receiving cavity therebetween for reception of said nozzle housing of said spray gun, and at least one set screw through each one of said wall members of said pair to bear against said nozzle housing when tightened.

9. A spray mist collector as set forth in claim 2, wherein said intake aperture means includes an intake aperture, removable filter retaining means positioned adjacent said intake aperture, said filter means includes a filter member receivable in said removable filter retaining means to cover said intake aperture when so received therein and removable therefrom when necessary to replace said filter member.

10. A spray mist collector as set forth in claim 9, wherein said intake aperture is bordered by a pair of spaced apart substantially straight edges, one on each opposite side, said filter member includes a corresponding pair of spaced apart substantially straight edges, one on each opposite side, an elongated receiving groove along each of said substantially straight edges of a one of said pairs of substantially straight edges of said intake aperture and said filter member, an elongated rib member along each of said substantially straight edges of the other of said pairs of substantially straight edges of said intake aperture and said filter member, said elongated receiving ribs of the said one being receivable in the said receiving grooves of the said other, said elongated receiving ribs and said receiving grooves comprising said removable filter retaining means.

11. A spray mist collector as set forth in claim 7, wherein said first and second large intake apertures are substantially rectangular, each having a pair of spaced apart substantially straight edges, a one of each pair on the opposite side of the other of each pair, an elongated receiving groove along each of said substantially straight edges of said first and second substantially rectangular intake apertures, a first substantially rectangular filter member having a pair of spaced apart substantially straight edges and an elongated rib along each of said substantially straight edges for reception in respective ones of said elongated receiving grooves of said first large intake aperture, a second substantially rectangular filter member having a pair of spaced apart substantially straight edges and an elongated rib along each of said substantially straight edges for reception in respective ones of said elongated receiving grooves of said second large intake aperture.

12. A spray mist collector for use with a spray gun having a nozzle to spray paint and other sprayable materials, comprising conduit means for connection to a vacuum generating source, and for allowing flow of air through said conduit means in the direction toward said vacuum generating source, intake aperture means operatively associated with said conduit means to draw a spray mist resulting from use of said spray gun into and through said intake aperture means and said conduit means, wherein said spray mist collector includes replaceable filter means positioned to filter particles from spray mist as it is drawn into said intake aperture means and said conduit means, and alarm means to signal when said replaceable filter means needs to be replaced.

13. A spray mist collector as set forth in claim 12, wherein said alarm means includes a sound generating member which provides an audible sound from flow of air thereby, said sound generating member being positioned for passage of air thereby as spray mist is drawn into said intake aperture means and said conduit means.

14. A spray mist collector as set forth in claim 12, wherein said sound generating member comprises a tubular member having a cavity therein, a sound generating aperture opening to said cavity to provide a said audible sound from flow of air by said tubular member, through said sound generating aperture and through said cavity of said tubular member.

15. A spray mist collector as set forth in claim 14, wherein said tubular member is a whistle.

16. A spray mist collector as set forth in claim 14, including a tubular extension extending from said conduit means of said spray mist collector and in air flow communication therewith, said tubular sound generating member being secured to said tubular extension, an adjusting valve in said tubular extension to control the flow of air through said tubular extension and through said tubular sound generating member secured thereto to thereby control and adjust the time at which said tubular sound generating member will begin to emit an audible sound.

17. A spray mist collector as set forth in claim 12, including adjusting means to adjust said alarm means to signal when said replaceable filter means needs to be replaced between a time when said filters are relatively less clogged and a time when they are relatively more clogged.

* * * * *